United States Patent [19]

Takato et al.

[11] Patent Number: 5,014,817

[45] Date of Patent: May 14, 1991

[54] ENGINE EXHAUST APPARATUS AND METHOD

[75] Inventors: Koji Takato; Hironobu Chiba, both of Hiroshima, Japan

[73] Assignee: Mazda Motor Corporation, Hiroshima, Japan

[21] Appl. No.: 384,791

[22] Filed: Jul. 25, 1989

[30] Foreign Application Priority Data

Jul. 29, 1988 [JP] Japan ..... 63-101641[U]

[51] Int. Cl.[5] ..... F01N 1/08

[52] U.S. Cl. ..... 181/254; 181/239; 181/240; 181/265; 181/268; 181/272; 181/296; 60/292; 60/312; 60/324

[58] Field of Search ..... 181/236, 254, 239, 240, 181/296, 265, 268; 60/288, 291, 292, 312, 324

[56] References Cited

U.S. PATENT DOCUMENTS

| | | | |
|---|---|---|---|
| 1,299,326 | 4/1919 | Gray | 181/236 |
| 3,892,071 | 7/1975 | Garcea | 60/288 |
| 3,908,366 | 9/1975 | Masaki | 60/288 X |
| 4,665,692 | 5/1987 | Inaba | 60/324 |
| 4,840,030 | 6/1989 | Ikeda et al. | 60/324 |

*Primary Examiner*—Benjamin R. Fuller

*Attorney, Agent, or Firm*—Fleit, Jacobson, Cohn, Price, Holman & Stern

[57] ABSTRACT

An engine exhaust apparatus in which an exhaust passageway of the engine is provided with a plurality of sound deadening passsages. One common exhaust passageway from the engine is branched into first and second exhaust passageways. Each of the first and second exhaust passageways has a silencer or muffler including first and second exhaust outlet tubes with a shift valve mounted in one of these exhaust outlet tubes. A control unit controls the shift valves to close both when engine speed is in a low region, to open one of them when engine speed is in a medium region and to open both when engine speed is in a high region.

13 Claims, 6 Drawing Sheets

ENGINE EXHAUST APPARATUS AND METHOD

BACKGROUND OF THE INVENTION

1. Field of the Invention

The present invention relates to an engine exhaust apparatus for a vehicle having a muffler or a silencer which eliminates exhaust gas noises and a method therefor.

2. Description of the Prior Art

In order to reduce sounds of exhaust gases from an engine, a muffler or a silencer is connected to an exhaust passageway. The sounds or noises of exhaust gases generated from the engine are classified roughly into two types. One type is a sound which is generated by the flow in the exhaust passageway. This sound is more pronounced in the high power operating condition of the engine when exhaust pressure becomes high than in the low power operating condition.

The other type is a sound which is generated by echoing in the exhaust passageway. This sound is more pronounced in the low power operating condition of the engine when exhaust pressure remains low than in the high power operating condition of the engine. It is thus noted that either of these two type sounds is more evident in the condition when the other type is decreased or less evident. Accordingly, as a result, sounds caused by exhaust gases cannot be reduced efficiently by using one muffler or silencer, because these two type sounds are incompatible to be erased at the same time.

Therefore, it is a recent trend that a plurality of mufflers or silencers having a shift valve are mounted on the exhaust passageway so as to be operated by a switching valve to open or close at least one of these mufflers or silencers.

For example, Japanese Utility Model Publication (Kokai) No. 58,611/1986 discloses an exhaust system in which one silencer or muffler is provided with two exhaust outlet tubes different in diameter from each other with a shift valve mounted on the large-diameter exhaust outlet tube. The shift valve is operated to close the large-diameter exhaust outlet tube in the region of low engine rotational speed where flow of exhaust gases is sufficiently small to be exhausted merely through the small-diameter exhaust outlet tube. This shift valve is also operated to open the large-diameter exhaust outlet tube so it and the small-diameter exhaust outlet tube are open in the region of high engine rotational speed where flow of exhaust gases is too large to be exhausted only by the small-diameter exhaust outlet tube.

It should be noted, however, in the above apparatus, exhaust gases flow increases extremely in the region of medium engine rotational speed; as a result, noisy sounds occur. Also, the noisy sounds disappear suddenly when the shift valve is opened in the high engine speed region, which gives vehicle drivers a strange feeling.

To suppress such flow sounds, a low pressure exhaust outlet tube may be applied; but, this leads to another problem, namely, echo sounds.

SUMMARY OF THE INVENTION

Therefore, an object of the present invention is to provide an engine exhaust apparatus for a vehicle capable of preventing echo sounds in the low engine speed region, lowering exhaust gases pressure in the high engine speed region and suppressing flow sounds in the medium engine speed region and a method therefor.

In accordance with the present invention, one common exhaust passageway branched into first and second exhaust passageways is provided. Both first and second branched exhaust passageways have a silencer or muffler including a first exhaust outlet tube and second exhaust outlet tube, respectively. Each silencer or muffler has a shift valve to open or close one of the first and second exhaust outlet tubes. The present invention further includes a controller to control the shift valves of both silencers or mufflers to close in the engine low speed region, to open one of these shift valves in the medium engine speed region and to open both the shift valves in the engine high speed region.

The above and other objects and features of the present invention will become apparent from the following description of a preferred embodiment making reference to the accompanying drawings.

DETAILED DESCRIPTION OF PREFERABLE EMBODIMENT OF THE INVENTION

1. Structure of the Embodiment

Figure 1:
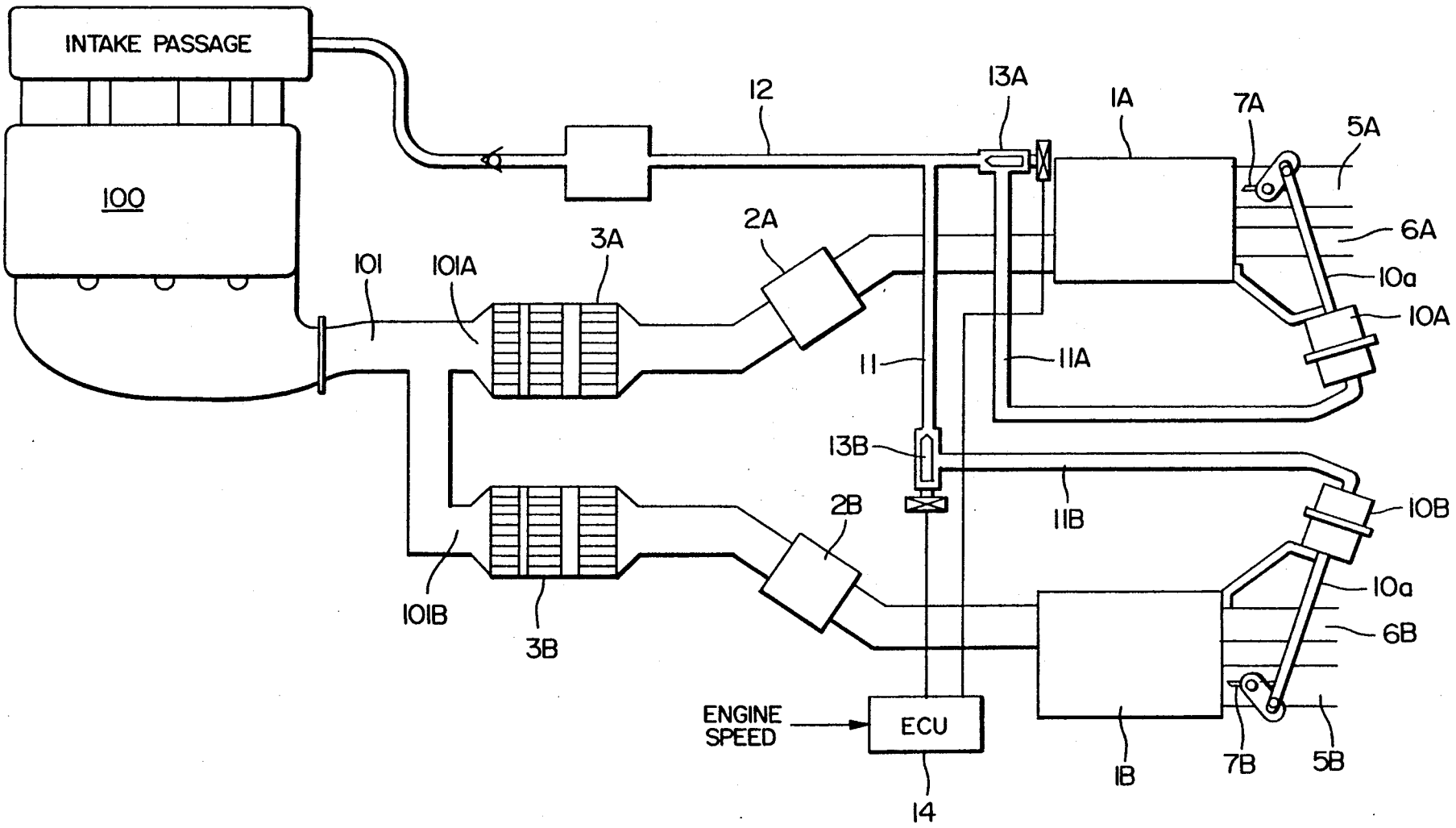
FIG. 1 is a schematic view showing an outline of one example of the engine exhaust apparatus in accordance with the present invention.

Referring to FIG. 1, one common exhaust passage 101 extending from an engine 100 is branched into a first branch exhaust passageway 101A and a second branch exhaust passageway 101B. The branch exhaust passageway 101A is provided from its upstream end to its downstream end with a catalyst converter 3A, a sub silencer 2A and a main silencer 1A in this order. Also, the other branch exhaust passageway 101B is provided from its upstream end to its downstream end with a catalyst converter 3B, a sub silencer 2B and a main silencer 1B like the branch exhaust passageway 101A.

As the main silencer 1A is constructed in substantially the same manner as the main silencer 1B, a description of the detail of the former alone will be sufficient to understand both. Any details of the latter which differ or are in addition to will be stated specifically.

Figure 2:
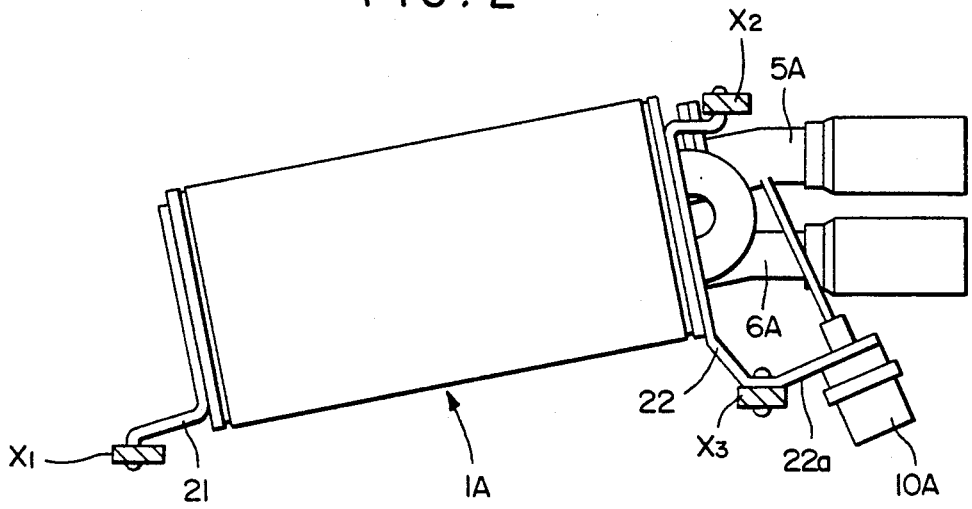
FIG. 2 is an enlarged side view showing the silencer shown in FIG. 1.

As shown in FIG. 2, the main silencer 1A is fixed to a vehicle body at points X1, X2 and X3 through brackets 21 and 22 and suitable fasteners. Three-point support by points X1, X2 and X3 is preferable for suppressing vibration of the silencer 1A, though the silencer 1A may be supported by two points X1 and X2 aligned on its diagonal line.

Figure 3:
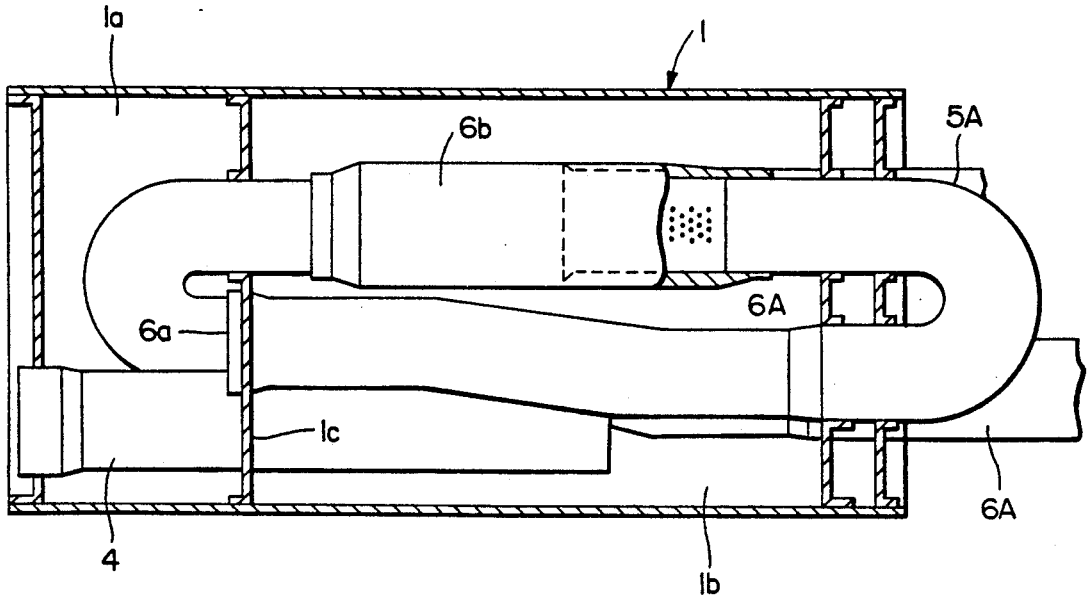
FIG. 3 is a view showing an interior structure of the silencer shown in FIG. 1.

Referring now to FIG. 3, the inside of the main silencer 1A is divided into two chambers, one being a resonance chamber 1*a* and the other being an expansion chamber 1*b*, which are communicated with each other through a through-hole 1*d* (not shown in FIG. 3 but shown in FIG. 4) provided on a partition wall interposed between the resonance chamber 1*a* and the expansion chamber 1*b*. The expansion chamber 1*b* is communicated with the outside of the main silencer 1A at one end through a straight exhaust inlet tube 4 passing through the resonance chamber 1*a* and communicated with the outside of the main silencer 1A at the other end through a straight first exhaust outlet tube 5A. The resonance chamber 1*a* is communicated with the outside of the main silencer 1A through a bent second exhaust outlet tube 6A. This second exhaust outlet tube 6A has a smaller diameter than the first exhaust outlet tube 5A, with an opening end 6*a* opening to the resonance chamber 1*a*. Also, this second exhaust outlet tube has a longer passage than the first exhaust outlet tube by being curved in an S-shaped manner, with sound absorber 6*b* provided on its intermediate portion (positioned in the expansion chamber 1*b*). The sound absorber 6*b* is structurally well known in the art. That is, a sound absorbing material is provided to surround the exhaust pipe at the portion where a plurality of small holes are provided.

Figure 4:
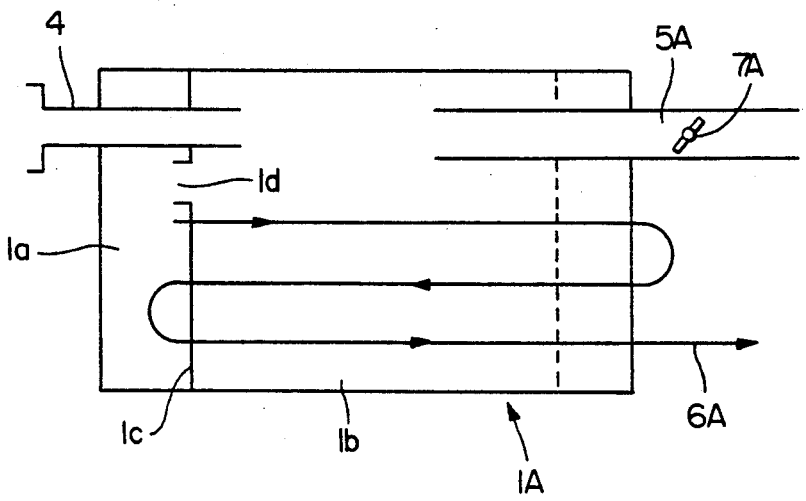
FIG. 4 is a diagram showing a manner of exhaust gases flow in the silencer shown in FIG. 1.

The flow route of the exhaust gases in the main silencer 1A is shown diagrammatically in FIG. 4. The passages of the main silencer 1A comprise a short exhaust passage passing through the exhaust inlet tube 4, the expansion chamber 1*b* and the first exhaust outlet tube 5A and a long exhaust passage passing through the exhaust inlet tube 4, the expansion chamber 1*b*, the hole 1*d*, the resonance chamber 1*a* and the second exhaust outlet tube 6A.

Figure 5:
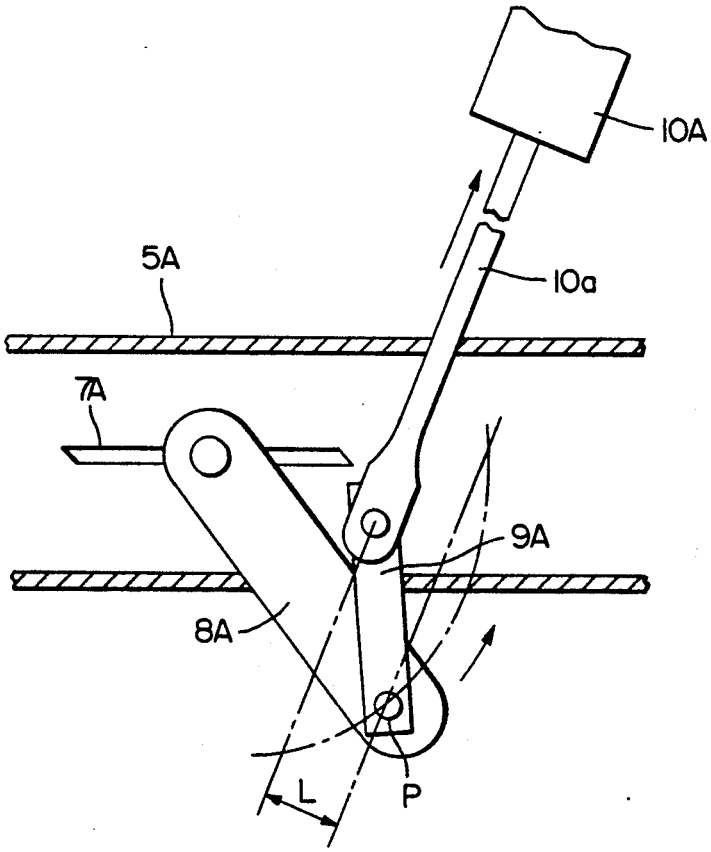
FIG. 5 is a view showing a detail of a shift valve mounted in the silencer shown in FIG. 1.

In the first exhaust outlet tube 5A, a shift valve 7A is provided to open or close the first exhaust outlet tube 5A as shown in FIG. 5. The shift valve 7A is connected to a rod 10*a* of an actuator 10A through pivotally interconnected links 8A and 9A. By pushing down or pulling up the rod 10*a*, the shift valve 7A opens or closes the first exhaust outlet tube 5A. A connecting point P of the links 8A and 9A is designed to remain on either side with respect to the axis of the rod 10*a*. When the valve 7A opens fully, the connecting point P is offset from the axis of the rod 10*a* at a distance of L.

The actuator 10A is fixed on an extended end 22*a* of the bracket 22 as shown in FIG. 2. To introduce negative pressure of intake air, the actuator 10A is connected to the intake passage downstream of the throttle valve (not shown) through a branched vacuum passage 11A and a common vacuum passage 12. The branch vacuum passage 11A is interposed by a three-way solenoid valve 13A connected to an ECU (electrical control unit) 14. The ECU 14 is designed to regulate operation of the actuator 10A for opening or closing the shift valve 7A by opening or closing the branched vacuum passage 11A with the three-way solenoid valve 13A. The same explanation applies about the actuator 11B which opens or closes shift valve 7B in exhaust outlet tube 58. Thus to introduce negative pressure of intake air, the actuator 10B is connected to the intake passage downstream of the throttle valve (not shown) through a branched vacuum passage 11B, a branched vacuum passage 11 and the common vacuum passage 12. The branched vacuum passage 11B is interposed by a three-way solenoid valve 13B connected to the ECU 14. The ECU 14 is designed to regulate operation of the actuator 10B for opening or closing the shift valve 7B by opening or closing the branched vacuum passage 11B with the three-way solenoid valve 13B.

Figure 6:
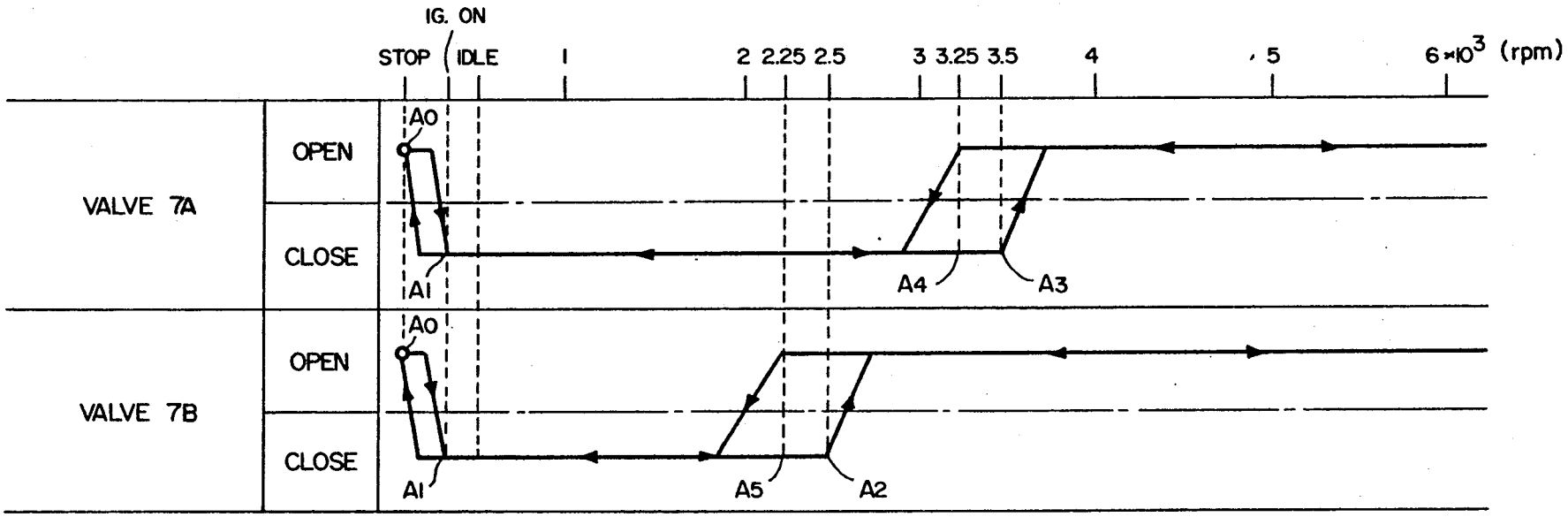
FIG. 6 is a view showing steps of the method and switching characteristics of two shift valves shown in FIG. 1.

As shown in FIG. 6, the shift valve con functions to open or close the shift valves 7A and 7B according to engine speed or a parameter of engine speed. It is preferable to set a hysteresis into the control to prevent hunting behavior of the shift valves 7A and 7B; this is portrayed in FIG. 6.

Namely, the actuator 10A, the three-way solenoid 13A and ECU 14 constitute a switching unit which actuates the shift valve 7A in accordance with engine speed. At first, the shift valve 7A is opened when the engine stops (point A0). Upon sensing the ignition (point A1), the ECU 14 outputs a close signal to the three-way solenoid valve 13A to close the shift valve 7A. The engine speed is monitored by conventional means and when the engine speed reaches 3500 rpm (point A3), the ECU 14 outputs an open signal to the three-way solenoid valve 13A to open the shift valve 7A.

When the engine speed decreases from its high speed region to its low speed region, the engine speed is monitored and when it reaches 3250 rpm [=3500−250] (point A4), the ECU 14 outputs a closing signal to the three-way solenoid valve 13A to close the shift valve 7A.

On the other hand, the shift valve 7B is opened when the engine stops (point A0). Upon sensing the ignition (point A1), the ECU 14 outputs a close signal to the three-way solenoid valve 13B to close the shift valve 7B. When the engine speed reaches 2500 rpm (point A2), the ECU 14 outputs an open signal to the three-way solenoid valve 13B to open the shift valve 7B.

When the engine speed decreases from its high speed region to its low speed region, the engine speed is sensed when it reaches 2250 rpm [=2500−250] (point A5), the ECU 14 outputs a closing signal to the three-way solenoid valve 13B to close the shift valve 7B.

Thus, the shift valve control is summarized as the following Table 1.

TABLE 1

| Engine speed | valve 7A | valve 7B |
|---|---|---|
| less than Idling | open | open |
| Idling to 2500 rpm | close | close |
| 2500 to 3500 rpm | close | open |
| more than 3500 rpm | open | open |

Next, the operation of this apparatus is explained. At first, both shift valves 7A and 7B are closed upon turning on the ignition switch, so exhaust gases are emitted only through the second exhaust outlet tubes 6A and 6B. This condition continues until the engine speed reaches 2500 rpm. Since this second exhaust outlet tube 6A (or 6B) is of smaller diameter and longer passage and includes the sound absorber 6*b*, it has adequate features to eliminate efficiently echo noise transmitted in a passenger compartment room.

Then, in case engine speed increases and remains within a zone of 2500 to 3500 rpm, the shift valve 7B is opened. Accordingly, the first exhaust outlet tube 5B is newly opened in addition to the second exhaust outlet tubes 6A and 6B. By this control, exhaust gas pressure is sufficiently lowered to prevent generation of flow noise due to high exhaust gas pressure.

Furthermore, in case engine speed increases beyond 3500 rpm, both the shift valves 7A and 7B are opened. Therefore, all the exhaust outlet tubes are fully opened, so engine power output increases.

Figure 7:
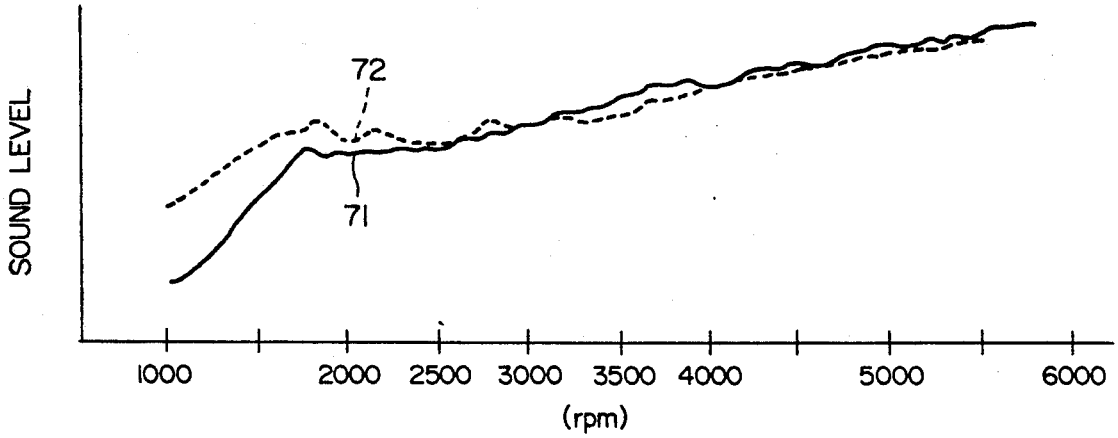
FIGS. 7 to 9 are graphs showing the relationship between engine speed and sound level under several conditions.
Figure 8:
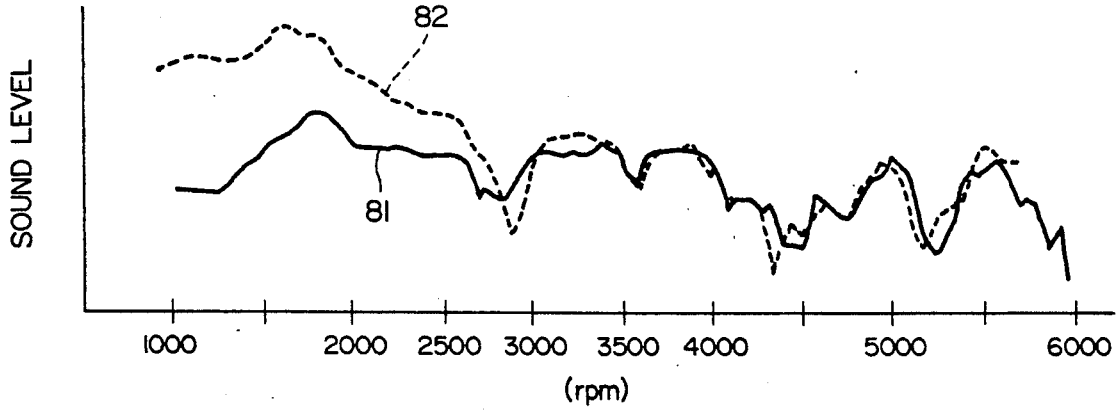
Figure 9:
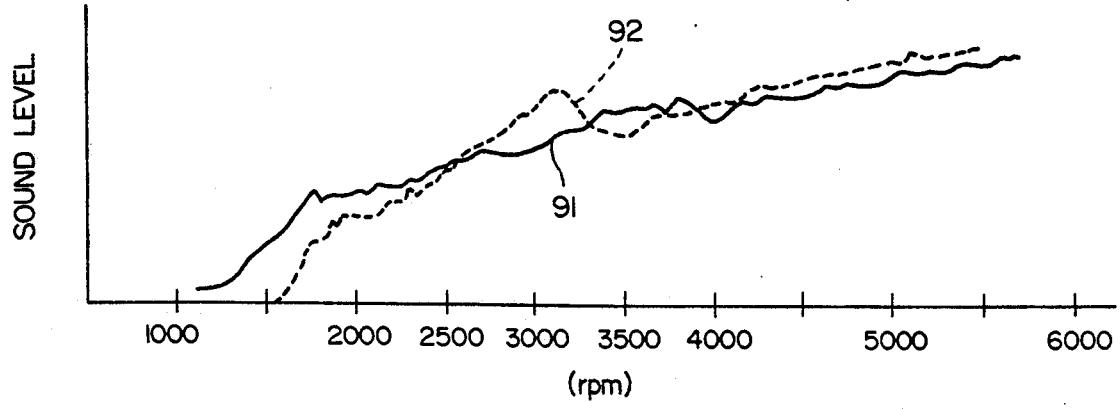

FIGS. 7 to 9 are graphs showing the relationship between actual engine speed and sound level of exhaust gas. FIG. 7 shows the result about all frequency components, and FIG. 8 shows the result about low frequency components. In FIGS. 7 and 8, solid lines 71 and 81 show the result of conventional apparatus having one silencer where the shift valves are controlled to switch between two stages; i.e., both the shift valves are closed in the lower engine speed region, but both the shift valves are opened in the higher engine speed region. The broken lines 72 and 82 show the result of another conventional apparatus where the shift valves are omitted. These FIGS. 7 and 8 show that the shift valves are effective to lower the sound or noise level in the engine low speed region.

FIG. 9 shows the result of the present invention compared with that of the conventional apparatus. That is, a solid line 91 shows the result of the present invention where both the shift valves 7A and 7B are switched among three stages. The broken line 92 shows the result of conventional apparatus having two silencers where the shift valves are controlled to switch between two stages. As shown in FIG. 9, the conventional apparatus has the problem that the sound or noise level increases extremely in the medium engine speed region and decreases suddenly after both shift valves are opened in the high engine speed region. However, in the present invention, such an extreme increase or sudden decrease of the sound does not appear. Accordingly, in this invention, flow sound or noise of exhaust gases in the medium engine speed region is suppressed and a steep change of the sounds or noises which is characteristic of the conventional apparatus does not occur, whereby drivers do not feel strangeness.

Figure 10:
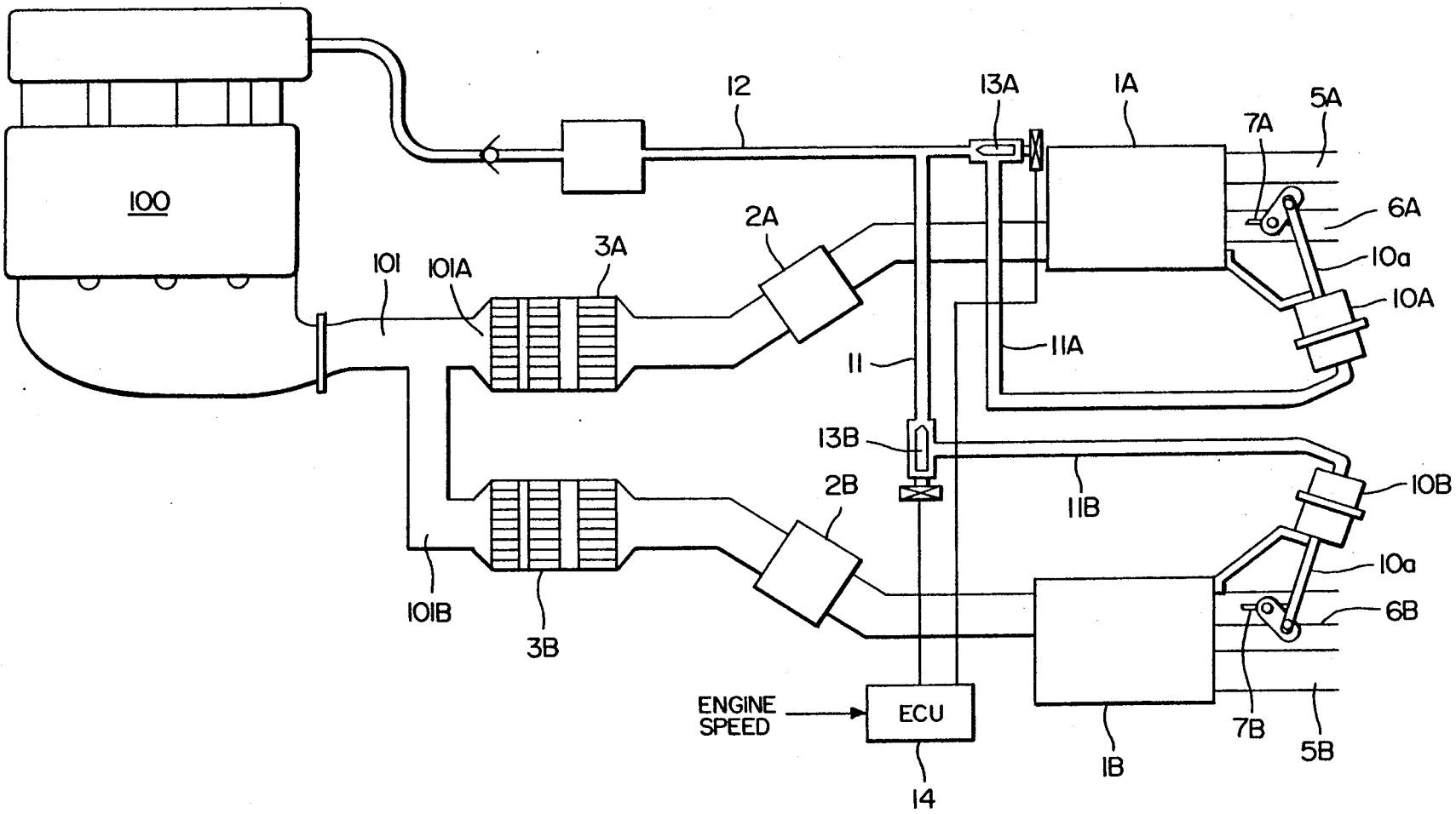
FIG. 10 is a schematic view showing an outline of another example of the engine exhaust apparatus in accordance with the present invention.

Though the above-described preferred embodiment adopts large-diameter first exhaust outlet tubes 5A and 5B, and provides shift valves 7A and 7B in these first exhaust outlet tubes 5A and 5B, the invention can be applied in such a manner that the shift valves 7A and 7B are provided in the second exhaust outlet tubes 6A and 6B which have smaller diameter than the first exhaust outlet tubes. This is shown in FIG. 10. Or, the first exhaust outlet tubes 5A and 5B can be designed to be the same diameter as the second exhaust outlet tubes 6A and 6B.

Other changes apparent to one skilled in the art can be made and such are deemed to fall within the purview of the invention.

We claim:

1. An exhaust apparatus for an engine of a vehicle comprising:

a common exhaust passageway extending from the engine and being branched into first and second branch exhaust passageways;

a silencer, having a plurality of sound deadening passages, provided in each of said first and second branch exhaust passageways;

a plurality of exhaust outlet tubes extending from each silencer;

a shift valve mounted in one of the exhaust outlet tubes extending from each silencer and adapted to switch between a first state and a second state for changing an exhaust gas flow through at least one sound deadening passage, said first state being an open state in which pressure of the exhaust gas is decreased and said second state being a closed state in which pressure of the exhaust gas is increased;

switching control means for controlling switching of each shift valve responsive to a state of running of the engine to place each shift valve in the closed state when engine speed is in a low range, to place one shift valve mounted in one of said exhaust outlet tubes extending from one silencer in the open state and to place another shift valve mounted in one of said exhaust outlet tubes extending from another silencer in the closed state when engine speed is in a medium range and to place each shift valve in the open state when engine speed is in a high range.

2. An engine exhaust apparatus in accordance with claim 1, wherein each silencer has first and second sound deadening passages.

3. An engine exhaust apparatus in accordance with claim 1, wherein said switching control means controls each shift valve to place each shift valve in the closed state responsive to turning on an ignition switch.

4. An engine exhaust apparatus in accordance with claim 1, wherein said switching control means controls each shift valve to place each shift valve in the closed state responsive to an idling state of the engine.

5. An engine exhaust apparatus in accordance with claim 2, wherein the first sound deadening passage has a larger passage area compared with the second sound deadening passage.

6. An engine exhaust apparatus in accordance with claim 2, wherein the first sound deadening passage has the same passage area as the second sound deadening passage.

7. Method of controlling exhaust from a vehicle comprising the steps of sensing engine speed of a vehicle;

dividing exhaust gases flowing out of the engine into at least two flow paths;

passing exhaust gasses flowing through each path through a silencing zone having at least two exhaust channels;

controlling the exhaust channels of the silencing zone responsive to engine speed to close one of said exhaust channels of each silencing zone when engine speed is in a low range, to close one of said exhaust channels of one of said silencing zones and to open said exhaust channels of the other of said silencing zones when engine speed is in a medium range and to open said exhaust channels of each silencing zone when engine speed is in a high range.

8. The method in accordance with claim 7, wherein each of said channels has a sound deadening portion.

9. The method in accordance with claim 7, wherein the one exhaust channels are closed responsive to starting of the vehicle.

10. The method in accordance with claim 7, wherein the one exhaust channels are closed responsive to an idling state of the vehicle engine.

11. The method in accordance with claim 8, wherein one sound deadening portion has a smaller flow resistance than the other sound deadening portion and closure is effected for the sound deadening portion having the smaller flow resistance.

12. The method in accordance with claim 8, wherein one sound deadening portion has a smaller flow resistance than the other sound deadening portion and closure is effected for the sound deadening portion having the larger flow resistance.

13. The method in accordance with claim 8, wherein the sound deadening portions have the same flow resistance.

* * * * *